United States Patent [19]

Lindström

[11] 4,133,462

[45] Jan. 9, 1979

[54] CONTAINER CLOSURE

[76] Inventor: Alrik C. Lindström, Vingåkersplan 12 S-125 40 Älvsjö, Sweden

[21] Appl. No.: 843,495

[22] Filed: Oct. 19, 1977

[51] Int. Cl.[2] ..... B65D 39/08

[52] U.S. Cl. ..... 222/546; 215/214; 215/252; 215/307

[58] Field of Search ..... 215/211, 214, 222, 223, 215/252, 307, 320, 332; 220/298, 299; 222/545, 546, 563, 541

[56] References Cited

U.S. PATENT DOCUMENTS

| | | | |
|---|---|---|---|
| 3,136,458 | 6/1964 | Ruetz | 222/563 X |
| 3,341,046 | 9/1967 | Bereziat | 222/546 X |
| 3,455,478 | 7/1969 | Fields | 215/252 |
| 3,704,819 | 12/1972 | Lindstrom | 222/546 |
| 3,860,152 | 1/1975 | Marti | 222/545 |
| 3,926,348 | 12/1975 | Lutzker | 222/563 X |

*Primary Examiner*—Donald F. Norton
*Attorney, Agent, or Firm*—Cushman, Darby & Cushman

[57] ABSTRACT

A closure for the mouth of a container includes a bottom part sealingly attachable to the mouth of the container, the bottom part having a central tubular portion projecting into and sealing with the container mouth. An upper part of the closure includes a cylindrical stopper portion which fits into the tubular portion and seals with at least one annular flange which is provided on the inner surface of the tubular portion.

5 Claims, 8 Drawing Figures

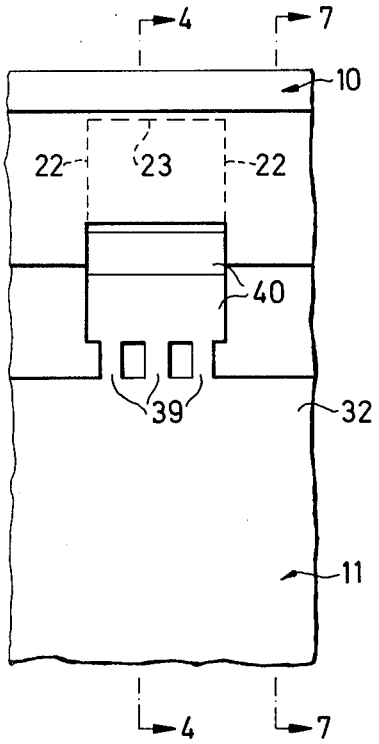
FIG. 3
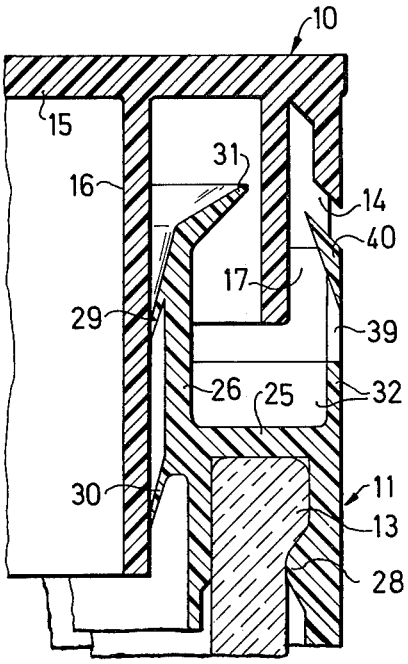
FIG. 4
FIG. 5
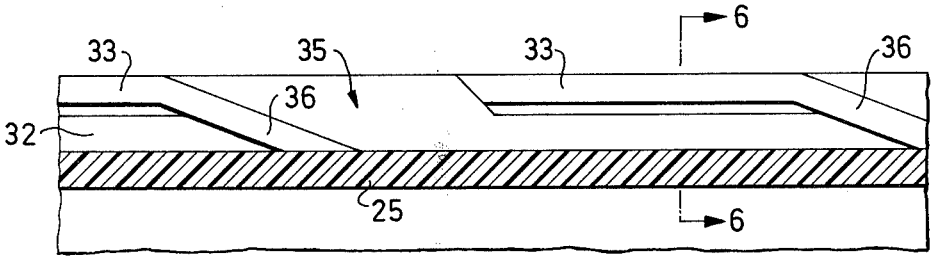
FIG. 6
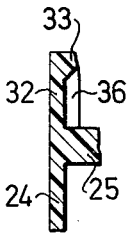

CONTAINER CLOSURE

The present invention relates to a closure means of the kind disclosed in the preamble to the following claim 1. The closure means is intended to bottles, jars and similar containers with a mouth substantially cylindrical internally.

For a long time it has been known to use a stopper of cork, rubber, plastic or other elastic material, particularly when it is a question of containers with relatively large tolerances on the inner diameter of the mouth. The diameter of the stopper has to be somewhat larger than the inside diameter of the container mouth, so that the stopper is compressed during insertion and thereby provides a seal. The stopper is usually in contact with the inside of the mouth along the whole of the part of the stopper which is pushed into the mouth. This involves a relatively large contact surface forming a sealing surface, but simultaneously forming a friction surface. In certain cases the stopper must be pressed in with relatively large force, so that it must also be pulled out with a correspondingly large force. If, furthermore, the contents of the bottle is a liquid which is sticky and also possibly has the property of drying out, a film of the liquid serving as a cementing agent can be obtained between the stopper and the mouth, making it very difficult to pull the stopper out.

In the mass production of glass bottles, for example, the inside diameter of the mouth in a certain series of bottles can vary within relatively wide limits. This means that the stoppers must be dimensioned for the greatest diameter allowed for the mouth. But the same stopper shall also be usable for the least mouth diameter in the series, where the stopper will thus be most compressed and thereby offer the greatest resistance to insertion and removal. The necessary maximum forces can usually be exerted by normally healthy and strong persons, but for handicapped or weak persons it can be impossible to pull out such a stopper, or press it into the mouth sufficiently hard for obtaining a seal.

In order to obtain a more easily handled closure it is conceivable to use a screw cap or a snap-on cap. In practice, however, such closures will also be in many cases nearly impossible to open with the small force and capacity of movement which can be achieved by a gravely disabled person. If a screw cap is to seal satisfactorily, there is namely the requirement that its bottom engages against the bottle mouth with a certain pressure, which in turn requires that the cap is tightened with a rather large force, and this usually means that a force at least as great is required to unscrew the cap. With regard to snap-on caps, relatively large forces are also required here, since these caps must be pressed over a bead when closing or opening.

Against the background of the abovementioned drawbacks in known closures, the invention has the object of providing a closure means with a stopper retained with very little frictional force in the sealing position irrespective of whether the mouth diameter of the container is in the upper or the lower portion of the tolerance range allowed for the prevailing series of containers.

This is achieved by a closure means which according to the invention has the characterizing features disclosed in the following claims.

The closure means according to the invention consists of two main parts in plastic, namely a lower part intended for attachment to the edge of the container mouth, and an upper part which is provided with a stopper fitting sealingly in the lower part. The lower part consists of elastically yielding plastic and can be provided with a groove in a known mode, into which the bead-shaped edge of the container mouth can be pressed and secured. Since the lower part is of elastically resilient plastic, it can be pressed onto a container mouth into a secured position, which mouth does not need to be precision made, but can be allowed to have a relatively wide diameter range. The lower part is cylindrical, and coaxially arranged inside it there is formed a tube-shaped sealing portion which on its inside has at least one annular flange projecting slopingly downwards. The free portion of the flange forms an elastic sealing ring, the diameter of which can be kept within narrow limits since the lower part is injection moulded with high precision in plastic in a known manner.

The upper part consists of a cover having a cylindrical or slightly tapering stopper position. The outer diameter of the stopper is somewhat larger than the inner diameter of said flange. When the stopper is pressed down into the lower part, it will push the flange out somewhat to engage with an elastically sealing pressure against the stopper. Since the upper part with stopper is also an injection moulded plastic detail, the stopper can be made with great accuracy so that the engagement pressure of the flange against the stopper will be substantially constant for the whole series of a certain size of closure means. When fitting to a container, the upper part is put together with the lower part as a unit, which can be pressed fast onto the container mouth by known closure machines.

Sealing tests with a closure means for bottles, made according to the invention, have shown that the stopper seals extremely effectively, while the force for inserting the stopper into the lower part is very small. Similarly, a very small force is also required for withdrawing the stopper, and it can be selected sufficiently small so that it substantially falls below the forces required in closures known up to now, where a stopper is pressed down sealingly in direct contact with the inside of the container mouth. The closure means according to the invention can thus be handled comfortably by persons who, for different reasons, cannot achieve the same forces as a normal healthy and strong person.

In order to obtain increased guidance of the stopper in the lower part, it is suitable to form the lower part with two axially spaced flanges on the inside of the tube-shaped sealing portion.

For transporting a container with the closure means according to the invention, it is suitable for the means to be provided with a bayonet fastening, known per se, between the upper part and lower part. The upper part can thereby be turned from a free position where it can be pulled out of the lower part to a locking position where locking teeth on the upper part coact with peripheral locking splines on the lower part. Without any inconvenience, the bayonet fastening can be so made that the upper part can be turned relatively easily from the locking position to the free position, since tightening down the bayonet fastening does not effect the efficient seal obtained between the stopper and the flange or flanges. In some cases it is, however, desirable to have a closure means where the bayonet fastening is relatively difficult to open after it has been locked. This is applicable to such containers which preferably cannot be opened by minors, e.g. children of about 3-4 years old. For this purpose, it is suitable to use an upper part wherein the locking teeth are somewhat larger than the locking teeth allowing turning with relatively small force. The larger locking teeth will then engage harder against the locking splines or engaging portions of the lower part, so that turning the upper part between the free and locked positions goes substantially more stiffly. If the cover is also made with a smooth outside, a small child cannot open the closure.

The closure means is also suitably provided with a security seal which must be broken in order to open the closure.

In cases where the closure means according to the invention is combined with a security seal which must be broken, and a locking device such as a bayonet fastening, it is usually necessary for the handicapped person to have help in opening the container the first time. Thereafter the handicapped person can open and close the closure means without difficulty, using the small force enabled by the means according to the invention.

These and other distinguishing features and advantages of the invention will be explained more closely while referring to an embodiment of the closure means according to the invention, shown as an example on the attached drawings.

FIG. 3 is a side view to an enlarged scale of a portion of the means shown in FIG. 1, and shows a security seal means, FIG. 4 is a section along the line 4—4 in FIG. 3 through the security seal means, FIG. 5 shows a portion of the inside of the lower part provided with a number of peripheral locking splines incorporated in a bayonet fastening for locking the closure means.

FIG. 6 is a section along the line 6—6 in FIG. 5,

Figure 1:
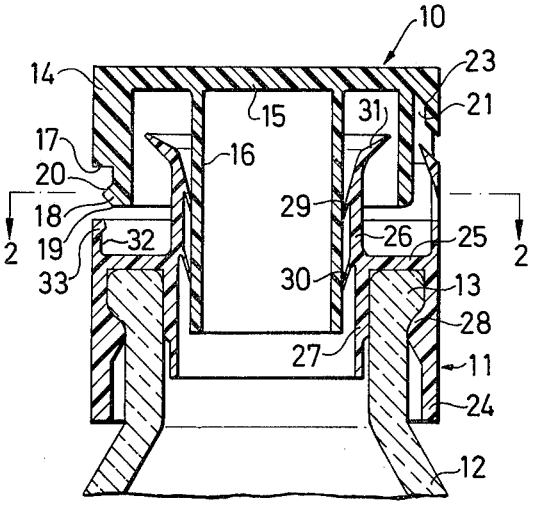
FIG. 1 is an axial section through the closure means according to the invention, mounted on the mouth of a bottle and with the upper part withdrawn to an intermediate position in relation to the lower part clamped onto the bottle.
Figure 2:
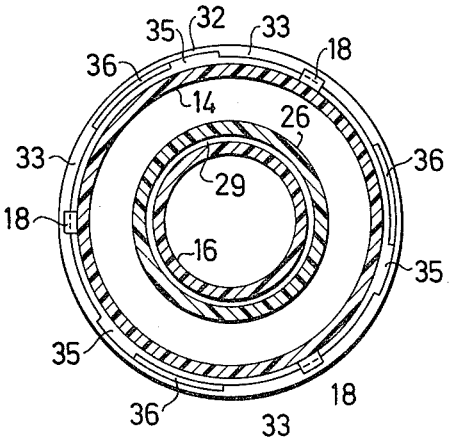
FIG. 2 is a cross section according to the line 2—2 in FIG. 1.

The closure means consists of two main plastic parts made by precision injection moulding, i.e. an upper part 10 serving as a cover or cap, and a lower portion 11 attached to the mouth of a container, which in the example shown in a glass bottle 12 with a bead-shaped mouth edge 13 whereon the bottom part is clamped fast. The upper part may be of relatively hard plastic, while the lower part is of somewhat softer and elastically yielding plastic.

The cap or upper part consists of a cylindrical portion 14 which is closed with a flat bottom 15 at its upper end. From the underside of the bottom there extends coaxially a cylindrical tubular stopper 16.

Figure 7:
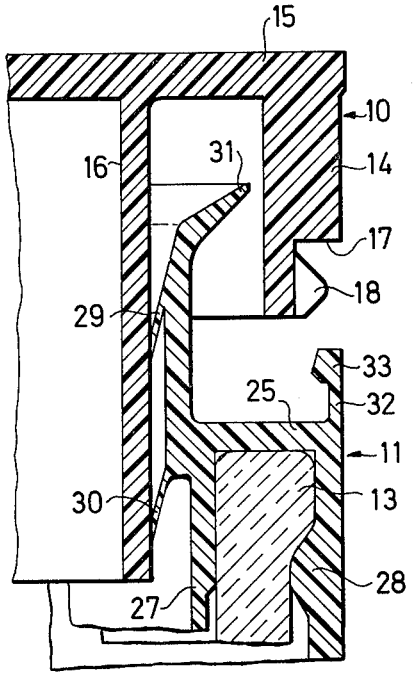
FIG. 7 is a section along the line 7—7 in FIG. 3 showing one of the radial teeth of the bayonet fastening, and FIG. 8 corresponds to FIG. 1, with the difference that the upper part is pressed down into its bottom position on the lower part, the security seal being shown in an unbroken condition.

The cylindrical wall has a groove 17 at its bottom edge, and at a plurality of places in this groove the upper part is formed with radially projecting locking teeth 18. In the example shown, the bottom sides 19 and top sides 20 of the teeth are chamfered (FIG. 7) to facilitate fitting the upper part to the lower part.

At a place along the circumference of the cylindrical wall, there is an axial pocket 21, having side walls 22 and a bottom wall 23, as apparent from FIGS. 3 and 4.

The bottom part 11, which is of an elastically resilient plastic, consists of a cylindrical wall 24 formed on its inside with a radial, annular intermediate wall 25, having its inner edge merging into an upwardly directed tubular sealing portion 26 and a downwardly directed sleeve 27 engaging sealingly with the inside of the mouth of the bottle 12. Below the intermediate wall 25, the cylindrical wall 24 is formed with an inwardly directed bead 28, gripping the beaded edge 13 of the bottle. Fitting the lower part is carried out in a known way by pressing it axially downwards onto the mouth of the bottle, the wall 24 deflecting outwards over the beaded edge 23 and the bead 28 snapping over the beaded edge 23 into the locked-on position shown. The part will be securely and tightly clamped on to the edge bead 13 even if the bottle mouth is not manufactured with any great dimensional accuracy.

On the inside of the cylindrical tube-like sealing portion 26 there are two flanges 29, 30, axially spaced and directed slopingly downwards. In the Figures, the cylindrical stopper 16 is inserted into the lower part and has expanded the elastically resilient flanges 29, 30 somewhat so that these engage with a certain pressure against the stopper to achieve an effective seal.

At its upper end the tube-like sealing portion 26 is flaired into a sealing flange 31 which also facilitates pouring a liquid from the container.

Above the intermediate wall, the cylindrical wall 24 forms an annular edge portion 32. On the inside of this there are formed peripheral locking splines 33 with the chamfered cross section apparent from FIG. 6. The splines are spaced from each other to form gaps 35 with which the locking teeth 18 can be meshed or unmeshed. At one end, each spline is provided with a slopingly downwardly directed guiding portion 36 extending right down to the intermediate wall.

When the upper part is fitted to the lower part, forming a unit which is subsequently to be fitted to the mouth of a container, this operation is suitably executed so that the upper part is placed in a predetermined rotary relationship to the lower part, whereafter both parts are pressed together into the position shown in FIG. 8. The locking teeth 18 of the upper part will thereby be guided into a position past the locking splines 33 while the annular edge portion 32 is elastically pressed out, whereafter the locking teeth finally snap down into the locking position below the locking splines, where the chamfered upper sides 20 of the locking teeth engage against the chamfered bottom sides of the splines 33. Chamfering the top sides 20 of the locking teeth makes it possible to open the security seal by withdrawing the upper part 10 axially without first turning it to the free position where the teeth are opposite the gaps 35 between the splines. The force required for this withdrawal is comparatively large however, for which reason this possibility is only intended as a reserve if the one using the closure does not understand that the upper part must be turned to disengage the bayonet fastening. When the upper part is turned, the teeth will strike against the sloping guiding portions 36 to ride up on these and out through the gaps 35.

If it is desired to have an upper part with a stiff bayonet fastening, this can be easily arranged by making the locking teeth 18 somewhat larger so that, for example, they press harder against the inside of the annular portion 32 or against the bottoms of the splines 33. The bayonet fastening can thus be made so stiff that small children, e.g. those about 3–4 years old, cannot open the fastening, which can be made even more difficult by making the outside of the upper part completely smooth.

As is apparent from FIGS. 3 and 4, and by way of example, there are three axial, relatively slender pins 39 formed at the edge of the annular portion 32 to carry a locking tongue 40 with parallel side edges and a cross section tapering towards its upper end as indicated in FIG. 4. When the upper part 10 is pressed down from the intermediate position in FIG. 4 to the bottom position in FIG. 8, the locking tongue 40 will be urged into a locking position in the pocket 21 to form a security seal. In this position the locking teeth 18 are under the splines 33. The security seal is further such that the locking tongue is completely sunken and thus does not form any projection which can be a hindrance in handling the closure means according to FIG. 8 in a closure machine.

To break the security seal, the upper part is turned relative to the lower part, the pins 39 being so slender that they are shorn off without difficulty. The locking tongue remains squeezed into the pocket 21.

Figure 8:
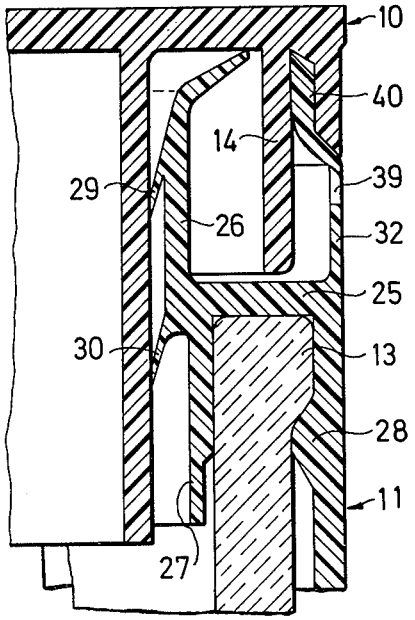

As is apparent from FIG. 8, the flanges 29, 30 seal against the stopper 16 so that a possible excess pressure in the container urges the flanges 29, 30 into harder contact against the stopper. On its part, the sealing flange 31 engages sealingly against the underside of the bottom 31 and is so directed that, in the event of a negative pressure occurring in the bottle, the flange 31 will press harder against the bottom 15. This can be of importance when the bottle is filled with a warm content, which is allowed to cool after fitting the closure means to the container.

What is claimed is:

1. A closure means for containers such as bottles, jars and the like, having a mouth which is substantially cylindrical on the inside, said closure means comprising two separate main parts of plastic situated axially in tandem, one main part forming a bottom part which at its lower end is sealingly attachable to the mouth edge of a container, and having interiorly a central, axial tube-like sealing portion which extends downwardly into and seals with a container mouth when said bottom part is attached to a container, said tube-like portion having on its inner surface two axially spaced-apart resilient annular flanges each of which slopes downwardly and radially inwardly, the second main part forming an upper part having a central, axial, outwardly cylindrical sealing stopper portion which is introduced into the tube-like sealing portion such that said flanges grip and seal with the circumference of said stopper portion.

2. A closure means as in claim 1 wherein said upper part is formed at its lower edge with a plurality of radially outwardly directed teeth distributed about the circumference of said upper part, said teeth coacting with a plurality of peripheral, bayonet fastening splines formed on the circumference of said lower part for enabling opening of the closure by turning the upper part relative to the lower part of a position where the teeth are free from the splines and the upper part can be withdrawn axially from the lower part.

3. A closure means as in claim 3 wherein said lower part is resilient plastic such that fitting the upper part to the lower part can be done by pressing surfaces of the teeth of the upper part axially against surfaces of the splines, at least one of said surfaces being chamfered such that the teeth radially deform the splines and the corresponding portion of the lower part to such an extent that the teeth can snap past the splines to the locking position of the teeth.

4. A closure means as in claim 4 wherein said lower part is formed at its end edge facing the upper part with at least one easily sheared axial pin, carrying an axial locking tongue, the latter being inserted in a complemental axial pocket in the upper part, so that turning the upper part in relation to the lower part causes shearing of the pin.

5. A closure means as in claim 1 wherein said tubular portion of said bottom part extends axially upwardly from the location of the uppermost of said flanges and terminates in a radially outwardly and upwardly flared flange, and wherein the thickness of said flanges is substantially less than the wall thickness of said tubular portion.

* * * * *